United States Patent [19]

Wyer

[11] Patent Number: 4,786,290

[45] Date of Patent: Nov. 22, 1988

[54] QUICK STARTING PACKAGE

[76] Inventor: Douglas B. Wyer, P.O. Box 2008, Jenks, Okla. 74037

[21] Appl. No.: 107,054

[22] Filed: Oct. 13, 1987

Related U.S. Application Data

[63] Continuation-in-part of Ser. No. 48,023, May 11, 1987, abandoned.

[51] Int. Cl.[4] ..... C10L 11/06; C10L 5/00

[52] U.S. Cl. ..... 44/519; 44/541

[58] Field of Search ..... 44/40, 38, 519, 541

[56] References Cited

U.S. PATENT DOCUMENTS

| | | | |
|---|---|---|---|
| 1,401,803 | 12/1921 | Lynes | 44/40 |
| 4,175,925 | 11/1979 | Paek et al. | 44/40 |
| 4,225,318 | 9/1980 | Wrigley, Jr. | 44/40 |

FOREIGN PATENT DOCUMENTS

| | | | |
|---|---|---|---|
| 389880 | 3/1931 | United Kingdom | 44/38 |

*Primary Examiner*—Carl F. Dees

[57] ABSTRACT

A burnable charcoal package comprising an outer package of burnable material containing a plurality of pieces of charcoal therein and an elongated burnable plastic container within the package below the pieces of charcoal, the elongated plastic container including a quantity of gel consisting of burnable material, an elongated fuse attached to the plastic container for the full length thereof and having an end portion projecting outwardly beyond the end of the plastic container, the arrangement of the plastic container in the package being such that the end of the fuse projects outwardly from the package itself, and an air channel disposed within the outer package beneath the charcoal and surrounding the plastic container, the charcoal being supported within the outer package above the channel, the upper and side portions of the channel being provided with openings to permit the passage of air therethrough and the lower periphery of the package containing air holes to permit the passage of air therethrough.

6 Claims, 2 Drawing Sheets

QUICK STARTING PACKAGE

CROSS REFERENCE TO RELATED APPLICATION

This application is a continuation-in-part of copending application Ser. No. 07/048,023 filed on May 11, 1987 (now abandoned) for "Quick Starting Package."

BACKGROUND OF THE INVENTION

1. Field of the Invention

This invention relates to a charcoal package to be used in an outdoor grill or Hibachi. More particularly, the charcoal package of the present invention will ignite easily and quickly and is convenient and safe to handle.

2. Prior Art

The prior art references of which the inventor is presently aware are listed as follows:

| Patentee | U.S. Pat. No. | Issue Date |
|---|---|---|
| Corwin | 362,147 | May 3, 1887 |
| Robinson | 967,242 | August 16, 1910 |
| Lynes | 1,401,803 | December 27, 1921 |
| Lammersen | 2,584,379 | April 10, 1951 |
| Bramhall et al | 2,622,017 | December 16, 1952 |
| Brody | 2,666,695 | January 19, 1954 |
| Peck | 3,010,809 | November 28, 1961 |
| Orsing | 3,651,596 | March 28, 1972 |
| Wrigley, Jr. | 4,225,318 | September 30, 1980 |
| Clayton et al | 4,179,270 | December 18, 1979 |
| Kretzschmann | 4,539,011 | September 3, 1985 |

The patent to Corwin discloses a block of wood saturated with kerosene and provided with a wick or fuse.

The patent to Robinson discloses a fire kindler made of wood wound with a wisk of fiber and bound by a cord. The wisk and cord have been dipped in paraffin and a fuse is provided to ignite the material.

The patent to Lynes shows a fire kindling device in the form of chemically treated excelsior wrapped around a filling of charcoal and provided with a fuse or wick.

The patent to Lammersen discloses a self-kindling charcoal fuel unit comprising a quantity of charcoal enclosed in combustible wrapper paper and being provided with a wick.

The patent to Bramhall discloses a kindling device comprising an outer container of crimped paper, an inner container also of crimped paper, a space between the containers filled with wax or paraffin, a wick and a body of combustible material disposed within the inner container.

The patent to Brody discloses a fuel package containing charcoal and a combustible material packaged within a container of paper. The container also includes a folded strip of cellophane. The combustible material is preferably trioxane. A fuse is also provided inside the folded strip.

The patent to Peck discloses a self-kindling charcoal package including a quantity of charcoal inside a bag. A cardboard grate is provided at the bottom of the bag. The bag and grate are made of combustible paper. The bag is provided with a tab for igniting the package.

The patent to Orsing discloses a fuel element comprising a porous noncombustible glass fiber casing and a combustible fuel inn solid form enclosed within the casing.

The patent to Wrigley, Jr. discloses a method of making a fire starting composition by solidifying a gel-foam in a sealed package.

The patent to Clayton et al discloses a fire kindling aid comprising a solid block which is a mixture of wax and cellulosic particles and one or more layers of absorbent material to absorb any of the wax material exuding from the block. The block is enclosed within a wrapper which is also combustible. A lighter strip, which is composed of a piece of slower burning material is situated between the wrapper and the block.

The patent to Kretzschmann discloses an artificial fireplace log consisting of a burnable sleeve enclosing a material which is more flammable than the sleeve. The flammable material consists of a mixture of wood wastes with paraffins. The sleeve is also provided with an ignition ridge consisting of a flammable filling.

SUMMARY OF THE INVENTION

The present invention includes a burnable package containing pieces of charcoal. On or near the bottom of the package is an elongated plastic container which includes a quantity of gel consisting essentially of denatured alchol. The plastic container is provided with an elongated fuse which extends for the full length of the container and has a portion projecting out from the bottom of the package to permit ignition of the entire package. The fuse is connected to the plastic container for the full length thereof by means of tape or glue so that the fuse, when burning, will burn in contact with the container to melt the plastic material of the container and burn the contents thereof.

An air channel is disposed within the outer package beneath the charcoal and surrounding the plastic container, the charcoal being supported within the outer package above the channel, the upper and side portions of the channel being provided with openings to permit the passage of air therethrough and the lower periphery of the outer package containing air holes to permit the passage of air therethrough.

DETAILED DESCRIPTION OF THE PREFERRED EMBODIMENTS

Figure 1:
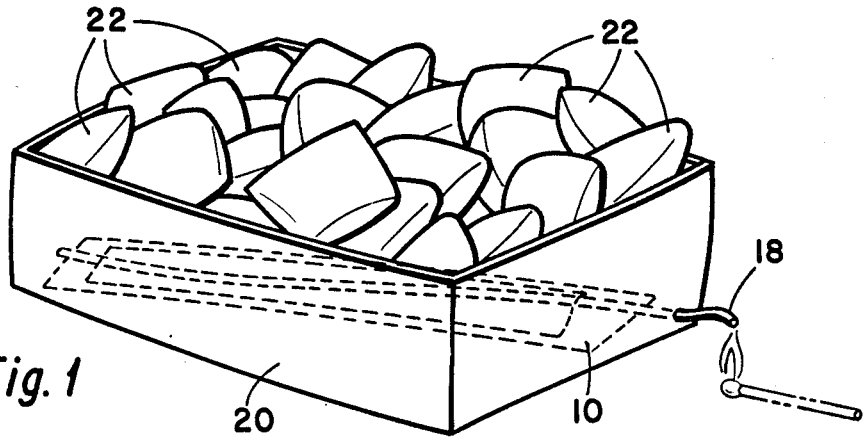
FIG. 1 is a perspective view of a complete burnable package (minus a preferred layer of shrink wrap which surrounds the package) showing the projecting fuse ready for ignition and illustrating a simplified form of the package.

Referring to the drawings in detail, FIG. 1 shows a simplified outer package or rectangular box 20 made of paper, light cardboard or other burnable material. The package 20 contains a plurality of pieces of charcoal 22.

Figure 3:
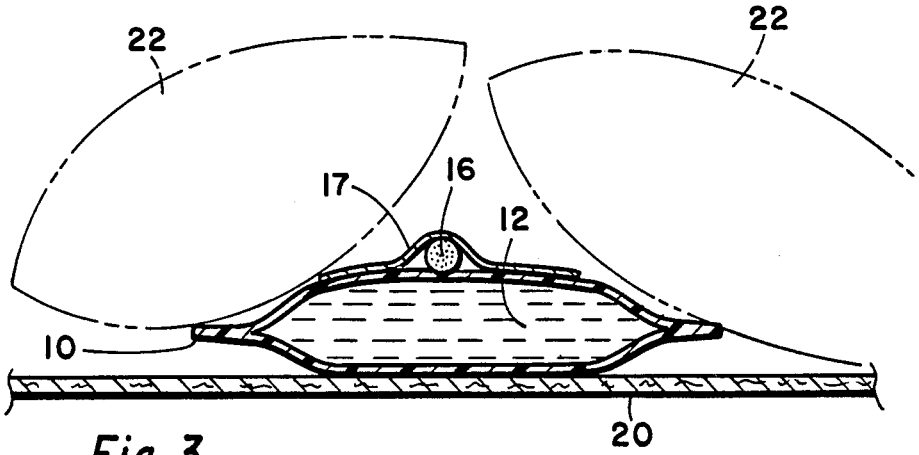
FIG. 3 is an enlarged sectional view through the bottom of the package of FIG. 1 showing the burnable plastic container in cross section with two superposed pieces of charcoal shown in phantom.

A burnable container 10 (later to be described in greater detail), is located adjacent to the bottom of the package and below the charcoal 22, as also shown in FIG. 3.

Figure 2:
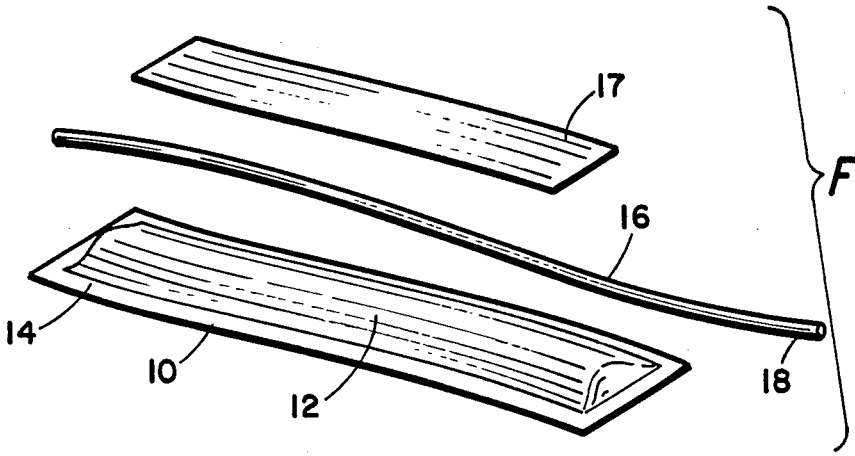
FIG. 2 is an exploded view of the components of the burnable plastic container.

Referring now to FIG. 2, the container 10 is preferably made of burnable plastic material. The container includes a quantity of gel 12 which consists essentially of denatured alcohol. The container 10 is made in a conventional manner with the gel 12 on the inside and the side edges 14 of the container 10 being sealed using conventional packaging techniques. An elongated fuse 16 is applied to the upper surface of the container 10 so as to extend for the full length thereof with a portion 18 projecting outwardly from one end. The fuse 16 is attached to the container for the full length thereof by means of glue (not shown) or a piece of tape 17.

Returning now to FIG. 1, the entire package (box plus contents) is preferably covered with a sheet of plastic material (not shown) such as "shrink wrap". If desired, a tab of the shrink wrap material can be wrapped around the end 18 of the fuse; alternatively, the end 18 of the fuse can project outwardly from the shrink wrap material.

Figure 4:
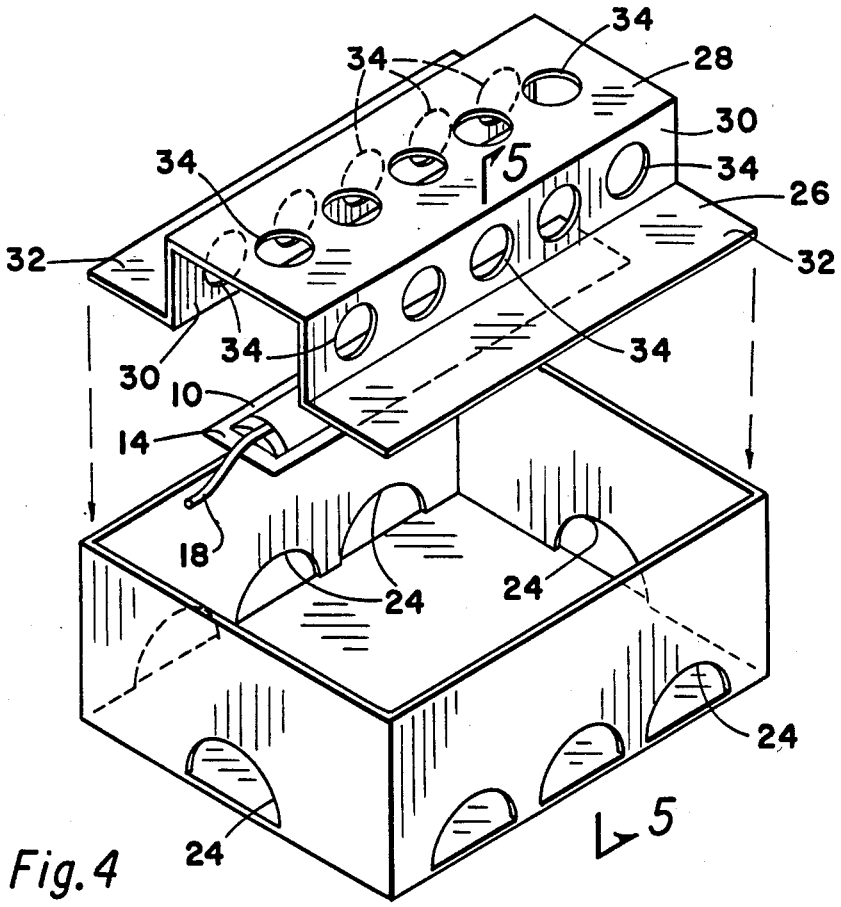
FIG. 4 is an exploded view of a preferred form of the package (minus the charcoal and shrink wrap) showing an added cardboard air channel and illustrating holes in the channel and the cardboard package.
Figure 5:
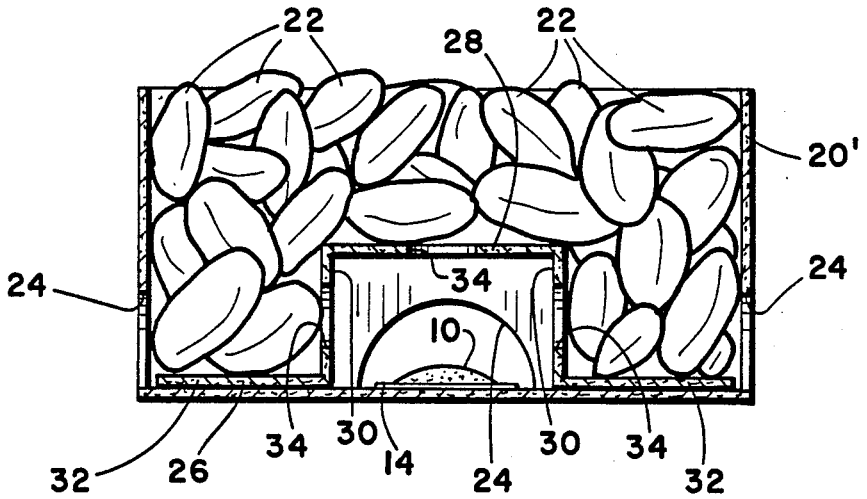
FIG. 5 is a sectional view taken along line 5—5 of FIG. 4 showing the burnable plastic container in cross section with the charcoal covering the space above the channel.

Referring now to FIG. 4, this is a perspective and exploded view of a preferred form of package or box 20' which is essentially the same as the box 20 shown in FIG. 1 except that it is provided with a plurality of openings 24 along the sides of the box adjacent the bottom. In addition, the box 20' of FIG. 4 is provided with an air channel 26 which is also constructed of paperlight cardboard or other burnable material. The channel 26 is composed of an upper flat portion 28, a pair of interconnecting and downwardly extending vertical sides 30 and a pair of outwardly extending horizontal side members 32 which connect with the bottom edges of the vertical side members 30. The center portion of the channel 26 thus constitutes an inverted "U". The top 28 and the vertical sides 30 are provided with a plurality of holes 34 to permit air to pass into the channel surrounding the burnable container 10 as shown in FIG. 5. The channel 26 is preferably dimensioned so that when this channel is placed in the bottom of the box 20', the center portion comprised of the upper flat member 28 and the vertical sides 30 will surround the burnable container 10 and the horizontal side flaps 32 will extend along the bottom of the box 20' to near the side edges of the box.

Whereas the package shown in FIG. 1 will burn adequately, the package shown in FIGS. 4 and 5 will burn faster and more efficiently because of the air passage provided by the channel member 26.

The wrapped package 10 can be sold in convenience stores or grocery stores. The puchaser need not open the package and therefore will not get his hands dirty from the charcoal. The purchaser merely sets the package 20 in the grill or Hibachi and then ignites the end of the fuse 18 or the tab (not shown) of shrink wrap material which is wrapped around the fuse. Within 15 to 45 minutes, the user will be able to grill hamburgers, hotdogs, etc. The entire package 20, of course, is consummable by fire.

Although the container 10 is preferrably filled with a quantity of gel 12 consisting essentially of denatured alcohol, other equivalent burnable liquids or gels could be employed. The fuse 16 can be made from any suitable fuse material. However, the present inventor prefers to employ an igniter cord sold under the name "Mantitor" and manufactured by Explo of Brazil. The "Mantitor" igniter cord is a relatively slow burning fuse which includes fuse material encased within a plastic cover, preferably PVC. Two aluminum wires extend for the full length of the fuse in the center thereof. The aluminum wires provide a certain amount of rigidity and permit the fuse to be held in a predetermined shape. The "Mantitor" burns at a rate of about 10 to 13 seconds per foot.

Whereas the present invention has been described in particular relation to the drawings attached thereto, it should be understood that other and further modifications, apart from those shown or suggested herein, may be made within the spirit and scope of this invention.

What is claimed is:

1. A burnable charcoal package comprising an outer package of burnable material containing a plurality of pieces of charcoal therein and an elongated burnable plastic container within the outer package below the pieces of charcoal, the elongated plastic container including a quantity of gel consisting of burnable material, an elongated fuse attached to the plastic container for the full length thereof and having an end portion projecting outwardly beyond the end of the plastic container, the arrangement of the plastic container in the package being such that the end of the fuse projects outwardly from the package itself.

2. A burnable charcoal package is set forth in claim 1 wherein the gel consists essentially of denatured alcohol.

3. A burnable charcoal package as set forth in claim 1 wherein the fuse is a slow burning fuse preferably having a burning time of approximately 10 to 13 seconds per foot.

4. A burnable charcoal package as set forth in claim 1 wherein the entire package is covered with "shrink wrap" material.

5. A burnable charcoal package as set forth in claim 1 wherein a channel structure of burnable material is inserted into the outer package prior to the placing of the charcoal therein, said channel structure surrounding the elongated plastic container and being provided with air holes therein.

6. A burnable charcoal package as set forth in claim 5 wherein the channel structure comprises an upper flat portion, a pair of downwardly extending vertical side members and a pair of outwardly extending horizontal members connected to the bottoms of the vertical side members, the air holes being in the upper flat portion and the vertical side members.

* * * * *